United States Patent [19]

Hope et al.

[11] 4,272,000

[45] * Jun. 9, 1981

[54] FILM GUIDANCE APPARATUS

[76] Inventors: Henry F. Hope, 3192 Huntingdon Rd., Huntingdon Valley, Pa. 19006; Stephen F. Hope, 2321 Wyandotte Rd., Willow Grove, Pa. 19090

[ * ] Notice: The portion of the term of this patent subsequent to May 1, 1996, has been disclaimed.

[21] Appl. No.: 3,666

[22] Filed: Jan. 15, 1979

Related U.S. Application Data

[63] Continuation of Ser. No. 810,510, Jun. 27, 1977, Pat. No. 4,151,942.

[51] Int. Cl.[3] ..... B65H 23/32

[52] U.S. Cl. ..... 226/1; 226/109; 226/199; 354/322; 354/339

[58] Field of Search ..... 226/109, 1, 199, 189, 226/4, 91, 92, 196, 89; 354/320, 322, 339; 242/76, 55, 55.3

[56] References Cited

U.S. PATENT DOCUMENTS

| | | | |
|---|---|---|---|
| 2,008,439 | 7/1935 | Ensign | 226/109 X |
| 2,949,248 | 8/1960 | Flynn et al. | 226/109 X |
| 3,366,025 | 1/1968 | Layne | 354/322 |
| 3,851,811 | 12/1974 | Turner | 226/199 |
| 4,151,942 | 5/1979 | Hope et al. | 226/1 |

*Primary Examiner*—Stanley N. Gilreath
*Attorney, Agent, or Firm*—Weiser, Stapler & Spivak

[57] ABSTRACT

In an automatic film processing machine a special film guidance apparatus is mounted ahead of the first processing tank to determine the paths along which the various film strips are introduced into the processing machine. The film guidance apparatus has transport rollers forming at least one nip, in front of which there are vanes spaced apart across the width of the transport rollers. These vanes subdivide the space in front of the nip into several channels, with sidewalls formed by the vanes. Each individual vane can be flipped into or out of the path of the film as that film is introduced between the vanes, and then into the nip of the rollers, for conveyance to the first processing tank of the machine. The machine operator is quickly and easily able to adjust the widths of the film insertion channels to accommodate film strips of different widths, which may then be processed side-by-side through the automatic processing machine without risk of interference with each other or with machine operation. An auxiliary roller aids in unrolling the film strips from their conventional spiral configuration.

17 Claims, 6 Drawing Figures

FILM GUIDANCE APPARATUS

This is a continuation of application Ser. No. 810,510, filed June 27, 1977 now U.S. Pat. No. 4,151,942.

This invention relates to improvements in apparatus and techniques for processing photographic film through automatic film developing machines.

In such film developing machines, the exposed film strips are typically carried by transport roller trains through a series of tanks, in which they are subjected to the various operations of developing, fixing, washing and so forth.

The total length of the path which the film strips thus travel through the developing machine is often considerable. This is due to the fact that the film strips must dwell in the various treatment tanks for periods of time which are sufficient to allow the respective processing operations to go to completion, even though the film strips are kept in continuous movement through the tanks.

The width of this path provided by the machine is, of course, at least as great as the width of the widest film strip which it is desired to process. Indeed, in practice, it is not unusual for a developing machine to have a width such that it can accomodate several separate film strips, side-by-side across the path which is defined by the transport rollers through the consecutive treatment baths.

This capability obviously enhances the total film strip footage which the machine can process in any given period of time, and that it is a very desirable feature of modern, high-speed developing machines.

However, the fact that the dimensions of the machine permit it to process several different film strips side-by-side also creates certain problems.

In particular, the paths which these different film strips follow longitudinally through the machine have to be laterally separated. If such separation does not prevail, then different strips may touch or even overlap, with seriously harmful effects on development quality.

Moreover, the desired lateral separation needs to be maintained even though film strips of various widths, such as the standard 8 mm, 16 mm, and 35 mm sizes, are processed through the same machine in more or less random sequence.

In addition to maintaining lateral separation between film strips being processed simultaneously, it is also desirable that the individual strips travel through the machine along paths which are in adequately close alignment with the longitudinal axis of the machine. If such alignment does not prevail, and if the film strips instead travel through the machine at an angle to the longitudinal axis, then there exists the danger that they may either become tangled up with one another, or they may approach too closely to the lateral edges of the transport rollers. In either case, defects in development result and, in an extreme case, there can even be jam-ups which require machine shut-down for their correction. This is not only time-consuming and expensive, but can also completely ruin the images on the film strips which were undergoing processing at the time the machine shut-down occurred.

It is therefore a primary object of the invention to provide a technique for guiding the film strips so as to alleviate the risks described above.

It is another object to provide such a guidance technique which involves apparatus that is comparatively simple in both construction and operation.

It is another object to provide such a technique which can provide the desired guidance to film strips of various widths.

It is another object of the present invention to provide apparatus for carrying out the technique which can be readily adjusted by the operator to accomodate film strips of various widths presented in random succession.

It is another object to provide such apparatus which permits the operator to make optimum use of available width of the processing machine to process the largest quantity of film strips in any given period of time.

These and other objects which will appear are achieved in accordance with the invention as follows.

Ahead of the inlet to the first processing tank and associated transport roller train of the machine, there is positioned a film guidance apparatus which includes an additional set of transport rollers, defining one or more consecutive nips for propelling film strips into engagement with the transport roller train of the processing tank. In front of the first nip defined by this additional set of transport rollers, there is positioned a plurality of flat plates or vanes, each having its plane surfaces oriented at right angles to the axes of the rollers. The different vanes are spaced apart laterally across the width of the nip defined by the transport rollers. These vanes therefore subdivide the space in front of the first nip into a plurality of channels, with side walls constituted by the plane surfaces of the adjacent vanes. The vanes are so positioned in relation to the first nip that the film strips will normally pass between two of these vanes as they are inserted into the nip. Different film strips are inserted into the machine between different pairs of vanes, for passage through the machine side-by-side along separate paths which do not interfere with each other.

Each individual vane can preferably be moved easily and quickly out of the insertion path of the film strips into the nip, and back again into that path. This enables the operator of the machine to quickly and easily adjust the widths of the channels defined by these vanes to accomodate film strips of different widths being processed.

Moreover, by making these vanes of sufficient width, in the dimension which parallels the film insertion path, these vanes can be used to guide the film into the nip, lined up with the lengthwise direction of the path which the film will subsequently follow through the machine.

Preferably, this film guidance apparatus also includes an auxiliary roller positioned ahead of the first nip. This auxiliary roller preferably counter-rotates with respect to the direction of travel of the film strips, and is smoothsurfaced. The film strips which are to be inserted into the developing machine are frequently rather tightly rolled up, in the spiral shape in which photographic film exists in the conventional cassette for camera use. The auxiliary roller assists in uncoiling the film strips as they pass into the film guidance apparatus and thereby cooperates with the remainder of that apparatus to reliably provide the desired separation and alignment of strips within the developing machine.

For further details, reference is made to the discussion which follows in the light of the accompanying drawings wherein FIG. 1 is an over-all view of a portion of the outer housing of film developing machine equipped with a film guidance apparatus in accordance with the invention, and with a portion of the outer machine housing broken away to show the construction of the guidance apparatus;

The same reference numerals are used in the different figures to designate similar elements.

Figure 1:
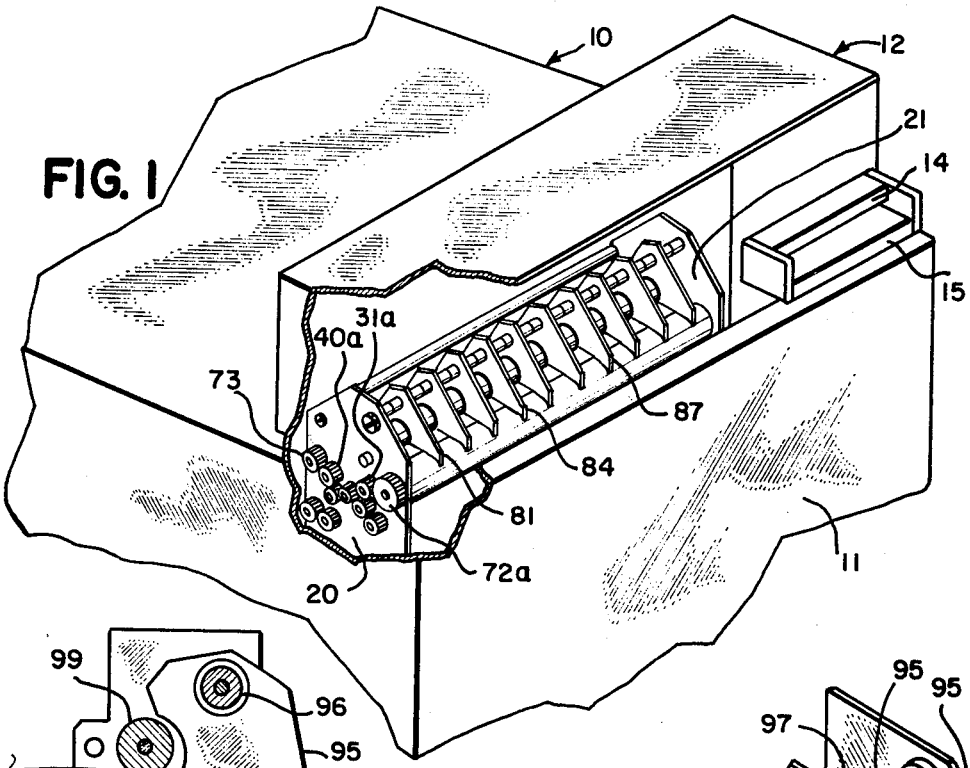

Referring to FIG. 1, this shows a housing 10 which contains, enclosed within the housing, all of the many components of a known type of film developing machine. These components (not shown) include particularly a series of tanks disposed side by side within housing 10 and containing the various chemical solutions through which the film must pass in order to be developed. Also positioned within these tanks are suitable racks of transport rollers which carry the film being developed through the tanks. To this extent, the film developing machine of FIG. 1 is entirely conventional and therefore need not be described in further detail here.

The film strips to be processed are introduced into the machine of FIG. 1 by an operator standing in front of face 11, which is at the input end of the machine. At this input end the otherwise generally rectangular housing 10 features an upward extension 12. Within this upward extension, there are housed two pieces of apparatus which cooperate with the remainder of the machine. One of these pieces of apparatus is a device for treating each film strip, prior to introduction into the machine, so as to free the leading end of the film strip to be processed from whatever tendency it may have to curl. This tendency of the film strip to curl stems, as previously noted, from the fact that photographic film is typically rolled up into a rather tight spiral for use in cameras, and this imparts to the film a permanent coiled configuration. To counteract this tendency to curl, which has the possibility of causing various adverse effects while the film is passing through the processing machine, the leading end of the film is first introduced into a slot defined between guides 14 and 15 protruding from housing extension 12. Apparatus within that housing extension (but not visible in FIG. 1) reacts to such introduction to impart to the leading end of the film deformations, such as corrugations, which render this leading end of the film strip substantially free of its prior inherent tendency to curl. Apparatus capable of performing this deforming of the film strip end is known, being taught, for example, in the copending U.S. patent application of the present inventors, Ser. No. 756,565, filed Jan. 3, 1977, the contents of which copending application are hereby incorporated in the present application as if fully set forth herein.

Also part of housing extension 12, there is a portion which is open toward machine face 11, i.e. toward the side before which the machine operator stands. Inside that open portion there is a pair of mounting plates 20, 21 to which there is attached the remainder of the film guidance apparatus embodying the present invention.

These mounting plates 20, 21 may be simply vertical extensions of the side plates which hold the transport roller train (not shown) for the first film processing tank of the developing machine.

Between mounting plates 20 and 21, there are positioned a plurality of rollers and various other components as described more fully below. The rollers, which are particularly clearly visible in FIG. 4, include a plurality of pairs designated by reference numerals 30, 31, 40, 41, 50, 51 and 60, 61. Each of the rollers 30, 40, 50 and 60 defines a nip with its respective adjacently numbered roller 31, 41, 51 and 61 and, together, these nips define a curved path for film strip 65 which is shown positioned within these nips in FIG. 4. The direction of travel of this film, under the influence of the transport roller pairs described above, is shown by arrow 66 in FIG. 4.

Figure 4:
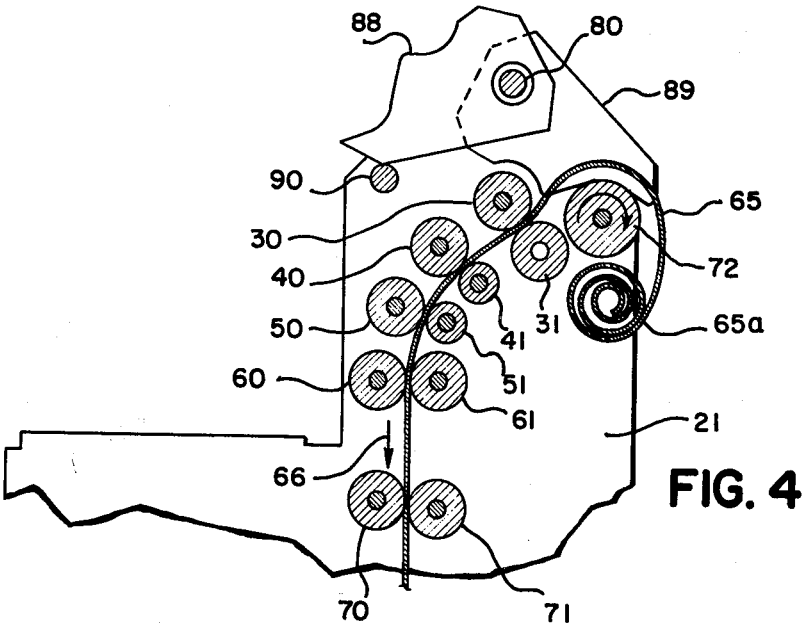
FIG. 4 is a sectional view of the guidance apparatus of FIG. 2, taken along 4—4 in that figure.

From the lower-most nip defined between rollers 60, 61 the film strip 65 is directed into the nip defined by still another pair of rollers 70, 71. These latter rollers 70, 71 may be considered as the first pair of rollers of the conventional transport roller train within the first tank of the film developing machine. At the opposite end of the set of roller pairs under discussion, there is an additional roller 72 which is not paired with any other roller and does not define a nip with any such other roller. As shown in FIG. 4, the film strip 65 passes over the top of roller 72 and then terminates in a spiral 65*a* which consists of the portion of the film as it comes out of the camera and before it has been processed through the film developing machine.

Figure 2:
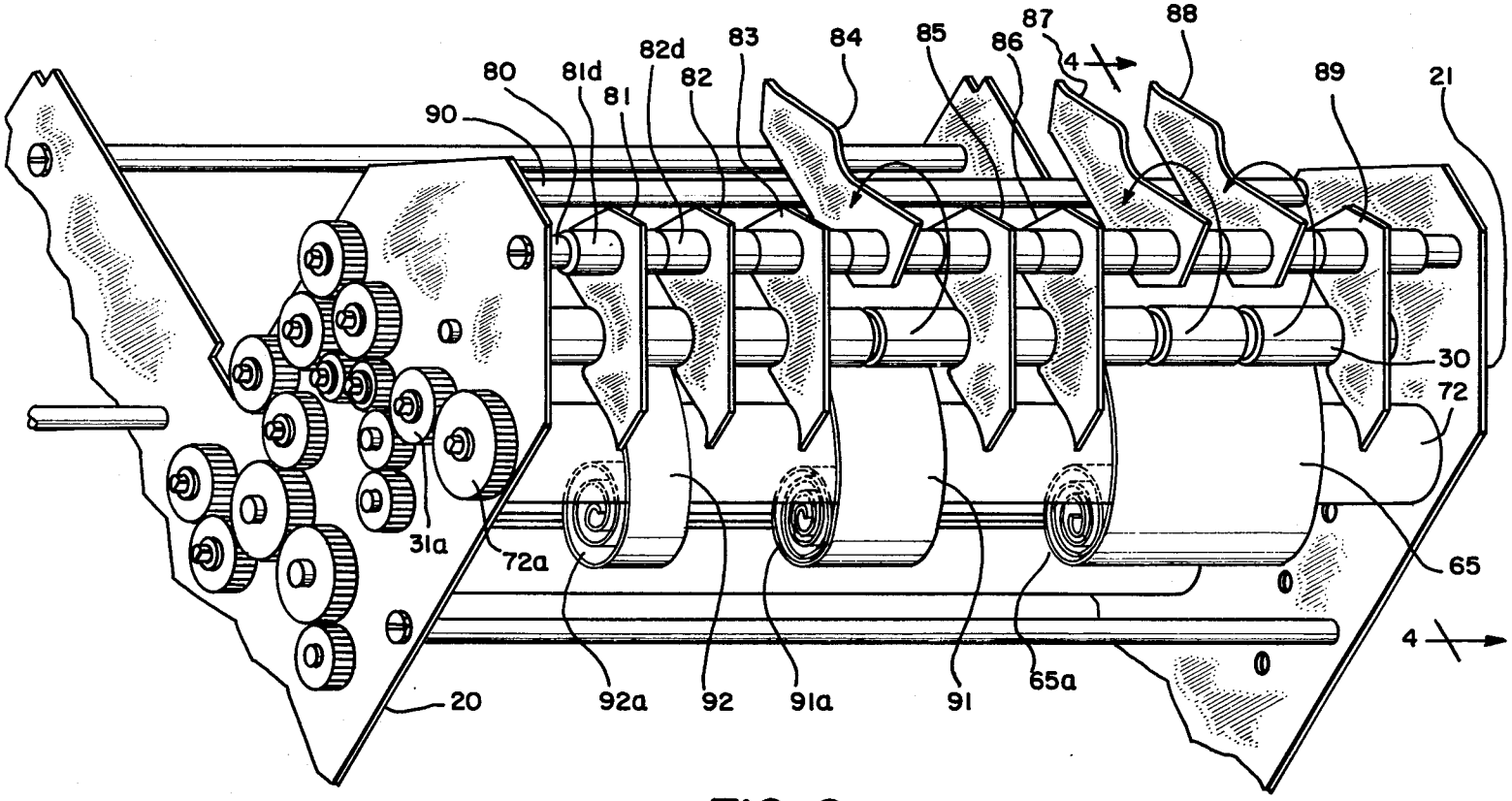
FIG. 2 is a detail view, drawn to a larger scale, of the guidance apparatus of FIG. 1.
Figure 3:
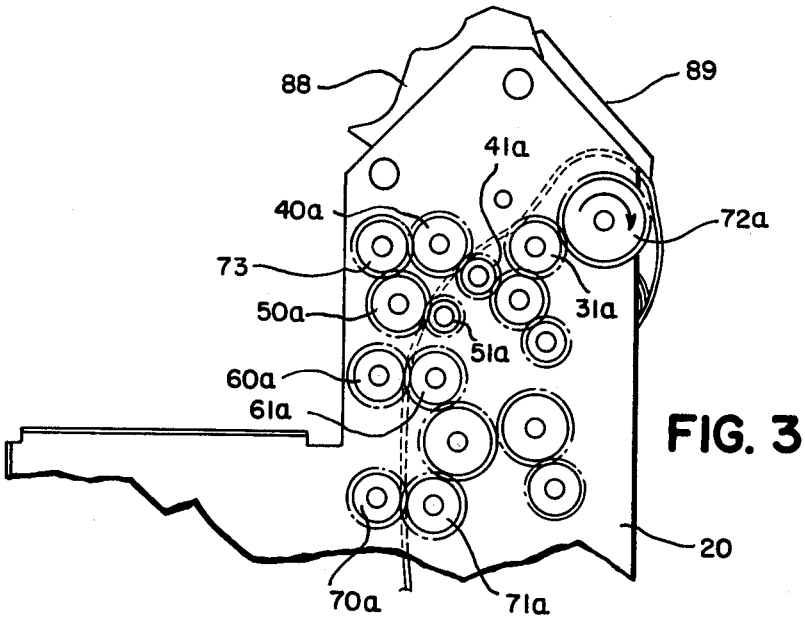
FIG. 3 is a side elevation of the guidance apparatus of FIGS. 1 and 2, taken from the same side from which that apparatus is viewed in FIG. 2.

FIG. 3, to which specific reference may now be had, shows a system of gears, some of which are mounted co-axially on the ends of the same shafts as the rollers shown in FIG. 4. These gears, together, provide rotating movement to the rollers of FIG. 4. In FIG. 3 each gear attached to the end of the same shaft as a roller is designated by the same reference numeral as the corresponding roller but followed by the suffix a. Thus, gear 40*a* in FIG. 3, for example, is attached to the end of the shaft of roller 40 in FIG. 4, and so forth for the other gears. It will be noted that there are gears shown in FIG. 3 which are not attached to the ends of roller shafts. For example, there is a gear 73 between gears 40*a* and 50*a*. This gear 73 serves to transmit driving force between gears 40*a* and 50*a* and also to provide the necessary rotation inversion so that gears 40*a* and 50*a*—and also the respective rollers 40 and 50 driven thereby—rotate in the same directions as necessary to propel film strip 65. In FIG. 3 (and this is likewise apparent in FIG. 2 which shows the same gear configuration) there is no connection shown between gears 50*a* and 60*a*. Such connection may be provided on the end of the apparatus of FIG. 2 opposite that of which is visible in that Figure, i.e. on the far side of mounting plate 21. This gear connection so positioned would not be visible in the drawings, being concealed from view by mounting plate 21.

As is most readily visible in FIG. 2, there is also provided positioned above the rollers a pivot bar 80 extending between mounting plates 20 and 21.

This bar 80, in turn, supports a series of plates or vanes 81 through 89. Each of these vanes has its flat surfaces positioned generally perpendicular to mounting bar 80 and to the rollers associated with this guidance apparatus. The vanes 81 through 89 may be made of any suitable material, such as plastic, which provides a significant amount of strength and rigidity to the vanes. For pivotal mounting on bar 80, each vane may be made as an integral protrusion from the middle of a sleeve which is in each case designated by the same reference numeral as the respective vane, but with the suffix d added. These sleeves also serve as spacers between vanes. As is particularly clearly visible in FIG. 4, each vane is shaped so that its lower edge rests, in one extreme pivotal position of the vane, upon roller 72. It is desired to give to each of these vanes a considerable dimension in the direction in which film strip 65 extends past roller 72 and into the nip between rollers 30 and 31. To that end, the portion of the vane edge adjacent roller 72 is curved so as to extend down along the roller in both directions. On the other hand, it is desired to have the lower edge of the vane not contact roller 30. For that reason, the portion of that lower edge of the vane adjacent roller 30 is curved sufficiently sharply upward so as not to contact that roller. In FIG. 2 vanes 81, 82, 83, 85, 86 and 89 are shown at that extreme pivotal position in which their lower edges rest on roller 72. On the other hand, vanes 84, 87 and 88 are shown in their opposite extreme pivotal positions in which their opposite edges rest upon bar 90. In FIG. 4, where only two vanes are visible, vane 88 is, of course, also shown resting on bar 90 while vane 89 rests on roller 72.

The manner of utilizing guidance apparatus in accordance with the present invention, will now be described.

Let it be assumed that, as shown in FIG. 2, three film strips, 65, 91 and 92, are to be simultaneously processed through the film developing machine 10 of FIG. 1. Let it further be assumed that film strip 92 is narrow enough to fit between two adjacent vanes of the guidance apparatus, and that film strip 91 is too wide to fit between two adjacent vanes, but requires the space between three consecutive vanes. Let it further be assumed that film strip 65 is even wider and requires the space between four consecutive vanes.

In that event, the leading end of film strip 92 (after having been treated to remove its tendency to curl if necessary) is inserted in the channel defined by vanes 81 and 82, passed over the top of roller 72 and thence introduced into the nip defined between roller 30 and roller 31 (the latter being more clearly visible in FIG. 4). Once this leading end of film strip 92 has been so introduced into the guidance apparatus, the remaining coiled portion 92*a* of this film strip can be tucked below roller 72, from where it will be progressively unrolled and transported through the set of roller pairs shown in FIG. 4, and finally into the processing tanks of developing machine 10.

With respect to film strip 91, this too will have its leading end treated to remove the tendency to curl, if necessary. Thereafter, it too will be introduced into the film guidance device by first passing it over the top of roller 72 and then into the nip between rollers 30 and 31. Before so introducing film strip 91, however, the operator of the machine will have taken vane 84 and pivoted it out of engagement with roller 72, and into the position shown in FIG. 2, with its opposite edge resting upon bar 90. Again the coiled remainder of film strip 91 is then tucked below roller 72 and the machine is allowed to operate upon film strip 91.

Finally, film strip 65, after also having had its leading end treated to remove the tendency to curl, if necessary, is introduced over the top of roller 72 into the nip between rollers 30 and 31. In this case, vanes 87 and 88 have first been pivoted out of the way, and into engagement with bar 90 and film strip 65 is introduced into the channel thereby provided between vanes 86 and 89.

By virtue of the fact that roller 72 rotates counter to the direction of movement of film strips 65, 91 and 92 into the machine, this roller 72 tends to maintain the remaining coiled film portions positioned adjacent to and below roller 72. It also assists in gradually uncoiling these remaining film strip portions as the film strips are progressively drawn into the interior of the developing machine. Because roller 72 is smoothfaced, its presence does not interfere with the ability of the remainder of the film guidance apparatus embodying the invention to transport the film through that apparatus and into the remainder of the developing machine.

It will now be apparent that the film guidance apparatus embodying the present invention is useful in insuring the desired lateral positioning and separation of film strips within the developing machine. By flipping various ones of the vanes 81 to 89 back and forth, into and out of the path of the film strip, it is possible to easily define varying patterns of channels for film strips of different widths. Moreover, the positions of these vanes, either resting on roller 72, or flipped back to rest on bar 90, provide an indication of the width of the film strip last inserted at that lateral position of the machine, even after that strip has been completely drawn into the machine and is therefore out of sight of the operator.

Also, by aligning the edges of the film strips parallel to the surfaces of the adjacent vanes it is possible to introduce the film strips into the developing machine closely paralleling the longitudinal axis of the machine.

Figure 6:
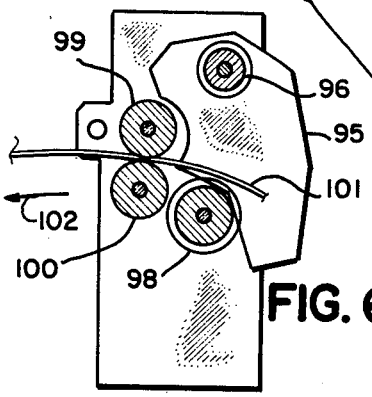
FIG. 6 is a sectional view of the embodiment of FIG. 5 taken along 6—6 in that figure.
Figure 5:
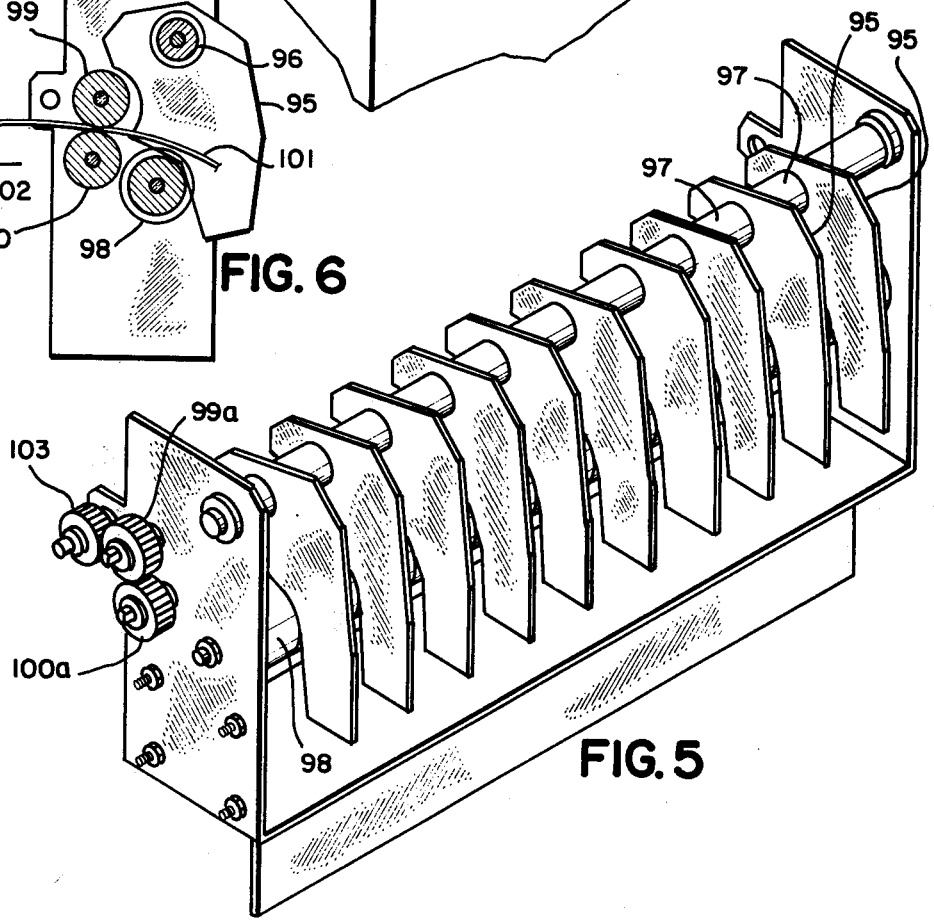
FIG. 5 is an isometric view of another embodiment of guidance apparatus in accordance with the invention.

Various modifications of the invention will occur to those skilled in the art. For example, FIGS. 5 and 6 show an alternative embodiment. In this embodiment, a plurality of vanes 95 are pivotably positioned about shaft 96. Spacer sleeves 97 surround shaft 96 and laterally separate the different vanes 95. The vanes 95 are capable of assuming two different positions. One position is that in which these vanes are shown in FIGS. 5 and 6, namely resting in grooves in roller 98. The other position (not shown) would be pivoted about shaft 96 (counterclockwise in FIG. 6) and therefore resting on roller 99. This roller 99 forms with roller 100 a nip through which a film strip 101 can be transported toward the remainder of the developing machine (not shown) for which the device of FIGS. 5 and 6 constitutes the film guidance apparatus.

In this embodiment, the roller 98, which is positioned ahead of the nip defined between rollers 99 and 100, is unpowered, i.e. not driven to rotate in either direction.

Preferably, however, to assist in the unwinding of the coiled film, roller 98 (as roller 72 in the previously disclosed embodiment) is adapted to be powered to rotate in a direction opposite the direction of travel of the film towards the nip.

In a preferred embodiment, the position of the first rollers which define a nip (e.g. rollers 98 and 100) and roller 98 (or 72) are so positioned relative to each other so that the film forms a loop over roller 98 (or 72) and is positioned tangentially said roller when in the nip.

Roller 98 is made of a smooth-surfaced material.

The remainder of the film processing machine with which the guidance apparatus of FIGS. 5 and 6 cooperates is not illustrated in these figures, because this machine may take any conventional form.

In the embodiment of FIGS. 5 and 6, the film strips emerge traveling generally horizontally from the guidance apparatus in the direction of arrow 102 in FIG. 6. If the remainder of machine is such that this is appropriate for introducing the film strips into the first treatment tank, then the apparatus of FIGS. 5 and 6 can simply be mounted ahead of the machine. If not, additional transport roller trains can be inserted between the guidance apparatus of FIGS. 5 and 6 and the machine to lead the film strips into the machine in the desired direction.

In accordance with the invention, if desired, all vanes may be in the second, or resting position (as on bar 90) so that a film of the full width of inlet can be processed. Also in accordance with the invention, some or all of the vanes can be so constructed to lend themselves for slidable adjustment along supporting bar 80 to provide even greater versitality to the apparatus of the invention.

Still other embodiments will readily occur to those skilled in the art.

We claim:

1. Apparatus for introducing film strips of various widths into a film processing machine in which these film strips are transported through a succession of treatment tanks, the apparatus comprising:

pair of film transport rollers, positioned between a pair of mounting plates, the pair of rollers defining a nip and being positioned ahead of the inlet to the treatment tanks so as to direct the film strips through the nip into the inlet, and plurality of spaced apart separating members positioned between the pair of mounting plates at predetermined intervals across the width of the pair of transport rollers, the separating members defining pairs of adjacent insertion channels, located on opposite sides of the separating members and ahead of the nip, which are of sufficient width to accept a strip of film therein, the size of each of the film insertion channels being defined by one of the separating members and either another separating member or a mounting plate, and the separating members being individually movable between a first position in which they are in front of the nip, to form the pairs of adjacent film insertion channels, and a second position in which they are not in front of the nip, to form channels capable of accepting strips of film having widths at least as great as the sum of the widths of the pairs of adjacent film insertion channels.

2. The apparatus of claim 1 wherein said separating members are pivotably mounted relative to the pair of transport rollers.

3. The apparatus of claim 2 wherein the separating members are mounted to pivot about an axis parallel to the transport rollers for movement between the first and second positions.

4. The apparatus of claim 3 wherein the separating members are equally spaced across the width of the transport rollers.

5. The apparatus of claim 4 wherein the separating members are flat vanes having surfaces at right angles to the axes of the transport rollers.

6. The apparatus of claim 5 having means for maintaining the vanes spaced from the nip-defining transport rollers in at least the first position.

7. The apparatus of claim 5 having means for maintaining the vanes spaced from the nip-defining transport rollers in both the first and second positions.

8. The apparatus of claim 6 wherein the means for maintaining the vanes spaced from the transport rollers in the first position is an auxiliary roller upon which rests an edge of each vane when such vane is in the first position.

9. The apparatus of claim 8 wherein the auxiliary roller does not define a nip with either of the pair.

10. The apparatus of claim 8 wherein the auxiliary roller does not define a nip with any other roller.

11. The apparatus of claim 1 and an auxiliary roller, upon which rests an edge of one of the separating members when such separating member is in the first position, to maintain the separating member spaced away from the nip-defining transport rollers in the first position.

12. The apparatus of claim 11 wherein the auxiliary roller does not define a nip with either of the pair of rollers.

13. The apparatus of claim 12 wherein the auxiliary roller is positioned generally ahead of the nip defined by the pair of transport rollers.

14. The apparatus of claim 11 wherein the auxiliary roller is capable of rotation in a direction opposite the direction of travel of the film.

15. The method of operating a film processing machine which has a succession of treatment tanks adapted to have film strips of various widths transported through them, and equipped with film introducing apparatus having a pair of film transport rollers, positioned between a pair of mounting plates, the pair of rollers defining a nip positioned ahead of the inlet to the treatment tanks, and having a plurality of spaced apart separating members positioned between the pair of mounting plates at predetermined intervals across the width of the nip, the separating members defining pairs of adjacent film insertion channels, located on opposite sides of the separating members and ahead of the nip, which are of sufficient width to accept a strip of film therein, the sides of each of the film insertion channels being defined by one of the separating members and either another separating member or a mounting plate and the separating members being adapted to be adjusted individually into positions in front of the nip to form the pairs of adjacent film insertion channels, or away from in front of the nip, to form channels capable of accepting strips of film having widths at least as great as the sum of the widths of the pairs of adjacent film insertion channels, the method comprising the steps of adjusting the different separating members in front of or away from in front of the nip so that each of a plurality of film strips to be simultaneously present in the nip is guided through a separate channel the width of which is determined by the position of the separating members, and introducing the different film strips into the nip through their respective separate channels.

16. The method of claim 15 which further comprises concurrently transporting the different film strips through the film processing machine.

17. Apparatus for introducing film strips of various widths into a film processing machine in which these film strips are transported through a succession of treatment tanks, the apparatus comprising:

a pair of film transport rollers, positioned between a pair of mounting plates, the pair of rollers defining a nip and being positioned ahead of the inlet to the treatment tanks so as to direct the film strips through the nip into the inlet, and at least one separating member positioned between the pair of mounting plates at a position which corresponds to the width of strips of film to be introduced into the film processing machine, the separating member defining a pair of adjacent film insertion channels located between the pair of mounting plates and on opposite sides of the separating member, each film insertion channel being positioned ahead of the nip and being of sufficient width to accept a strip of film therein.

* * * * *